US005262766A

United States Patent [19]

Sakamoto et al.

[11] Patent Number: 5,262,766

[45] Date of Patent: Nov. 16, 1993

[54] DISPLAY UNIT HAVING BRIGHTNESS CONTROL FUNCTION

[75] Inventors: Atsushi Sakamoto; Shigeyuki Harada, both of Nara; Kyoichi Yamamoto, Yamatokoriyama; Toshihiro Ohba; Hiroshi Kishishita, both of Nara, all of Japan

[73] Assignee: Sharp Kabushiki Kaisha, Osaka, Japan

[21] Appl. No.: 761,653

[22] Filed: Sep. 18, 1991

[30] Foreign Application Priority Data

Sep. 19, 1990 [JP] Japan ..... 2-251076

[51] Int. Cl.[5] ..... G09G 3/20

[52] U.S. Cl. ..... 345/148; 345/77

[58] Field of Search ..... 340/767, 805, 812, 793, 340/781; 358/168, 190, 230

[56] References Cited

U.S. PATENT DOCUMENTS 4,021,607 5/1977 Amano ..... 358/230
4,636,789 1/1987 Yamaguchi et al. ..... 340/805
4,859,910 8/1989 Iwakawa et al. ..... 340/805
4,951,041 8/1990 Inada et al. ..... 340/767

FOREIGN PATENT DOCUMENTS 0345399 12/1989 European Pat. Off. .

*Primary Examiner*—Alvin E. Oberley
*Assistant Examiner*—Matthew Luu

[57] ABSTRACT

A display unit includes a thin film EL display panel, a scanning side switching circuit connected to a scanning side electrode, a data side switching circuit connected to a data side electrode, a scanning side drive circuit which outputs a high voltage pulse to the scanning side switching circuit and a data side drive circuit which outputs a signal voltage to the data side switching circuit. It further includes a device for decreasing a pulse width of a high voltage pulse supplied from the scanning side drive circuit to the scanning side switching circuit in accordance with an increase of the level of a high voltage generated by a high voltage power supply in the scanning side drive circuit.

16 Claims, 9 Drawing Sheets

FIG. 1(1) WAVEFORM OF A VERTICAL SYNCHRONIZING SIGNAL V

FIG. 1(2) PULSE WAVEFORM OF A WRITING VOLTAGE VW 1

FIG. 1(3) HIGH VOLTAGE OUTPUT WAVEFORM OF THE HIGH VOLTAGE POWER SUPPLY

FIG. 3(1) WAVEFORM OF A VERTICAL SYNCHRONIZING SIGNAL V
FIG. 3(2) WAVEFORM OF A CONTROL SIGNAL HVC

FIG. 3(4) WAVEFORM OF A CONTROL SIGNAL HVC2
V1
HVC1

FIG.5(1) WAVEFORM OF A VERTICAL SYNCHRONIZING SIGNAL V
FIG.5(2) WAVEFORM OF A CONTROL SIGNAL HVC

FIG.5(4) WAVEFORM OF A CONTROL SIGNAL HVC4
HV1
HVC3

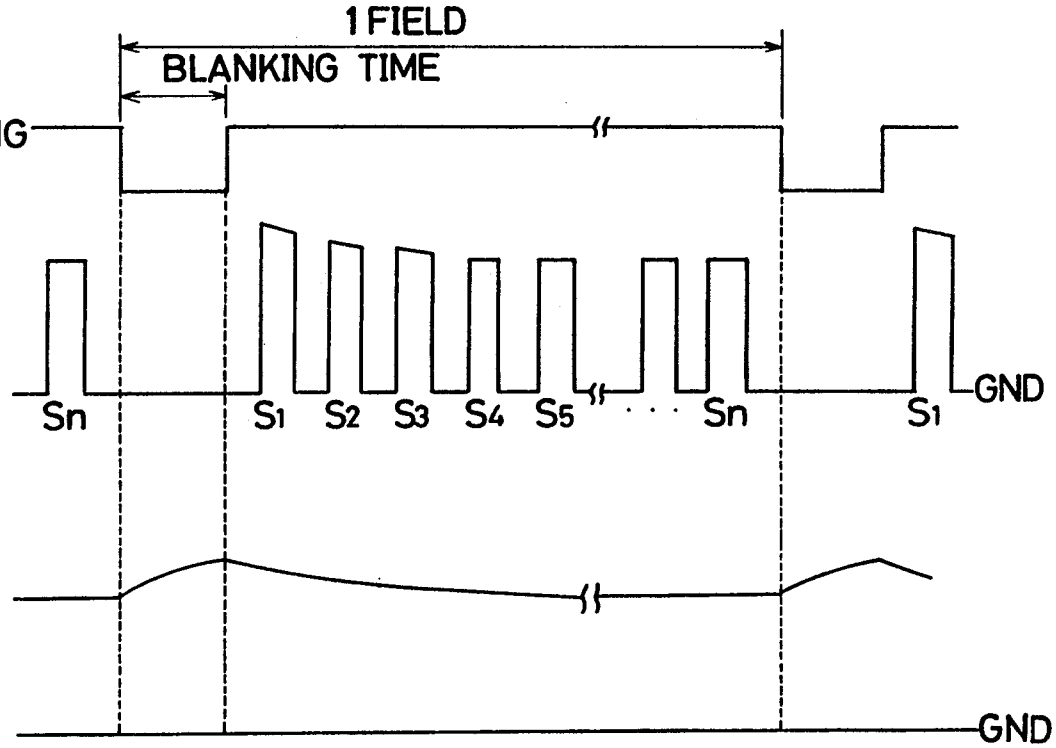
FIG.9(1) PRIOR ART WAVEFORM OF A VERTICAL SYNCHRONIZING SIGNAL V
FIG.9(2) PRIOR ART PULSE WAVEFORM OF A WRITING VOLTAGE VW1
FIG.9(3) PRIOR ART HIGH VOLTAGE OUTPUT WAVEFORM OF THE HIGH VOLTAGE POWER SUPPLY HV

DISPLAY UNIT HAVING BRIGHTNESS CONTROL FUNCTION

BACKGROUND OF THE INVENTION

1. Field of the Invention

The present invention relates to a display unit such as a capacitive flat matrix display (referred to as a thin film EL display hereinafter) or a plasma display.

2. Description of the Prior Art

FIG. 6 is a block diagram showing a structure of a common thin film EL display unit.

A display panel 1 is formed of a thin film EL element. In the thin film EL element, belt-shaped transparent electrodes are arranged in parallel on a glass substrate, a three-layer structure is formed by laminating a dielectric material, an EL layer, thereon and the dielectric material thereon and then arranging belt-shaped back electrodes in parallel in a direction crossing at a right angle to the transparent electrodes. The thin film El element is driven by a comparatively high voltage of approximately 200 V as is apparent from an applied voltage-brightness characteristic graph shown in FIG. 7.

In the display panel 1, the transparent electrodes of the thin film EL element are designated by data side electrodes D1 to Dm and the back electrodes of the thin film EL element are designated by scanning side electrodes S1 to Sn.

A data side switching circuit 2 is a circuit for individually applying a modulation voltage VM to each of data side electrodes D1 to Dm. The circuit comprises a data side output port group 3 connected to each of the data side electrodes D1 to Dm and a logical circuit 4 which receives display data corresponding to each of the data side electrodes D1 to Dm and turns the data side output port group 3 on and off in accordance with the display data.

A scanning side switching circuit 5 is a circuit for sequentially applying writing voltages VW1 and −VW2 (VW1=VW2+VM) to the scanning side electrodes S1 to Sn in order. The circuit comprises a scanning side output port group 6 connected to each of the scanning side electrodes S1 to Sn and a logical circuit 7 which turns the scanning side output port group 6 on and off in accordance with the order of the scanning side electrodes S1 to Sn.

A drive circuit 8 is a circuit for generating a high voltage for driving the display panel 1 from a constant reference voltage VD. The circuit comprises a modulation drive circuit 9 for applying the modulation voltage VM to the data side output port group 3 and a writing drive circuit 10 for applying the writing voltages VW1 and −VW2 to the scanning side output port group 6.

A driving logical circuit 11 is a circuit for generating various timing signals necessary for drive of the display panel 1 in accordance with an input signal such as display data D, a data transfer clock CK, a horizontal synchronizing signal H or a vertical synchronizing signal V.

Fundamental drive of the display unit, in which a period over two first and second fields is one cycle, is performed by applying the modulation voltage VM corresponding to the display data which decides emission or non-emission, to the data side electrodes D1 to Dm, while applying the voltage VW1 in the first field and the voltage −VW2 in the second field as the writing voltage to the scanning side electrodes S1 to Sn in order.

By this display drive, a superimposed effect or an offset effect of the writing voltages VW1, −VW2 and the modulation voltage VM is generated at a pixel where the data side electrodes D1 to Dm and the scanning side electrodes S1 to Sn cross. As the thin film EL element forming the display panel 1 shows the applied voltage-brightness characteristic shown in FIG. 7, the voltage VW1 of an emission threshold voltage Vth or more or the voltage VW2 of the emission threshold voltage Vth or less is applied to the pixel as an effective voltage by the superimposed effect and the offset effect of the writing voltages VW1, −VW2 and the modulation voltage VM. Thus, each pixel becomes either an emission or non-emission state and then a predetermined display can be obtained.

Therefore, the effective voltage whose polarity is inverted is alternatively applied to one pixel in the first and second fields, whereby symmetrical AC drive, which is ideal for the thin film EL element, can be performed in the two fields of one cycle.

FIG. 8 is a block diagram showing a structure of the writing drive circuit 10 and the driving logical circuit 11 in detail. The writing drive circuit 10 comprises a high voltage power supply 13 which generates a high voltage HV and a switching element 12 for obtaining pulse-shaped writing voltages VW1 and VW2 which correspond to the timing when the scanning side output port group 6 specifies the row of each pixel in the display panel 1 by intermittently supplying the high voltage HV to the scanning side output port group 6. On and off of the switching element 12 is controlled by a control signal HVC from the driving logical circuit 11.

In addition, the driving logical circuit 11 comprises a memory 14 such as a read only memory and the control signal HVC is output in accordance with the timing written in the memory 14.

FIG. 9 shows timing charts illustrating the timing of the drive of the display unit, in which FIG. 9(1) shows a vertical synchronizing signal V. FIG. 9(2) shows a pulse waveform of the writing voltage applied to the scanning side electrodes S1 to Sn; and FIG. 9(3) shows a waveform of the high voltage HV output from the high voltage power supply 13 in the writing drive circuit 10.

According to the conventional display unit, there is fluctuation in the high voltage HV output from the high voltage power supply 13 in the writing drive circuit 10 as shown in FIG. 9. Therefore, the amplitude of the pulse voltage applied as the writing voltages Vw1 and −Vw2 varies according to the scanning side electrode. As a result, a brightness difference is generated between scanning lines on a screen, causing display quality to be considerably deteriorated.

More specifically, as shown in FIG. 9(1), after the writing voltage is applied to the last scanning side electrode Sn, there is a blank period in the vertical synchronizing signal V before it is applied to the first scanning side electrode S1 in the next field. For this period a load to the high voltage power supply 13 is decreased and then an output level of the high voltage power supply 13 is increased as shown in FIG. 9(3). Thus, even if the writing voltage starts to be applied to the scanning side electrode S1, the output level does not immediately return to a predetermined value and the output level is kept high for a while. As a result, the writing voltage applied to the first scanning side electrode S1 is higher than that applied to the last scanning side electrode Sn, so that a brightness difference between the scanning lines is generated.

As means for solving the above problems, it is thought that load fluctuation of the high voltage power supply 13 itself should be held down. However, in this case, it is necessary to insert a large capacity capacitor into an output stage of the high voltage power supply 13 or increase control precision of the control circuit for the high voltage power supply 13, causing an increase of the number of parts, which in turn causes an increase in cost.

SUMMARY OF THE INVENTION

It is a main object of the present invention to provide a display unit having a brightness adjustment function in which a brightness difference is prevented from being generated between scanning lines on a screen, without increasing its cost.

According to the present invention, there is provided a display unit having a brightness control function comprising a display panel arranged in a direction where a plurality of scanning side electrodes and a plurality of data side electrodes cross, with a pixel formed at every intersecting point of the scanning side electrode and the data side electrode; scanning side switching circuit connected to the scanning side electrode for selectively outputting a high voltage to the scanning side electrode to sequentially specify a row of the pixel; a data side switching circuit connected to the data side electrode for outputting a signal voltage to the data side electrode to apply the signal voltage corresponding to display data to each column of the pixel a scanning side drive circuit including a high voltage power supply for generating the high voltage and supplying a high voltage pulse to the scanning side switching circuit in response to the timing when the scanning side switching circuit sequentially specifies the row of the pixel; and a data side drive circuit for inputting the signal voltage to the data side switching circuit, said display unit further including means for decreasing a pulse width of the high voltage pulse supplied from the scanning side drive circuit to the scanning side switching circuit in accordance with the increase of the level of the high voltage generated by the high voltage power supply in the scanning side drive circuit.

Thus, according to the present invention, when an amplitude of the writing voltage is increased in accordance with an increase of an output level of the high voltage power supply in the scanning side drive circuit, a panel width of the writing voltage is accordingly decreased. As a result, a pixel of any scanning side electrode on a screen has a uniform brightness and then display can be implemented with uniform brightness.

As described above, according to the display unit of the present invention, since a pulse width of a writing voltage is decreased as an amplitude of the writing voltage is increased in accordance with an increase of an output level of a high voltage power supply in a scanning side drive circuit, a pixel on any scanning side electrode on a screen can have the same brightness without being influenced by output fluctuation of the high voltage power supply, whereby display can be implemented with uniform brightness without increasing it cost.

DESCRIPTION OF THE DRAWINGS

An embodiment of the invention will now be described by way of example and with reference to the accompanying drawings, in which.

FIGS. 9(1–3) are timing charts showing drive timing of the conventional thin film EL display unit.

DESCRIPTION OF THE PREFERRED EMBODIMENTS

Figure 1:
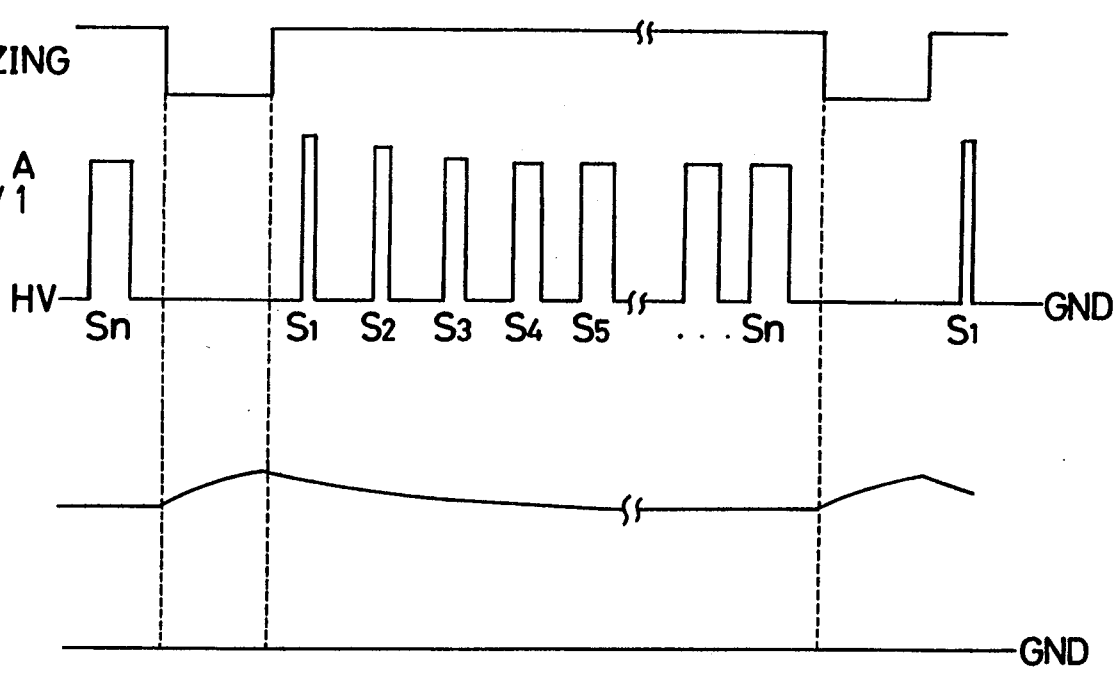
FIGS. 1(1–3) are timing charts showing a drive timing of a display unit in accordance with a first embodiment of the present invention.

FIG. 1 is a timing chart showing a timing of drive of a display unit in accordance with a first embodiment of the present invention, in which FIG. 1(1) shows a waveform of a vertical synchronizing signal, FIG. 1(2) shows a pulse waveform of a writing voltage and FIG. 1(3) shows a high voltage output waveform of the high voltage power supply 13.

Figure 6:
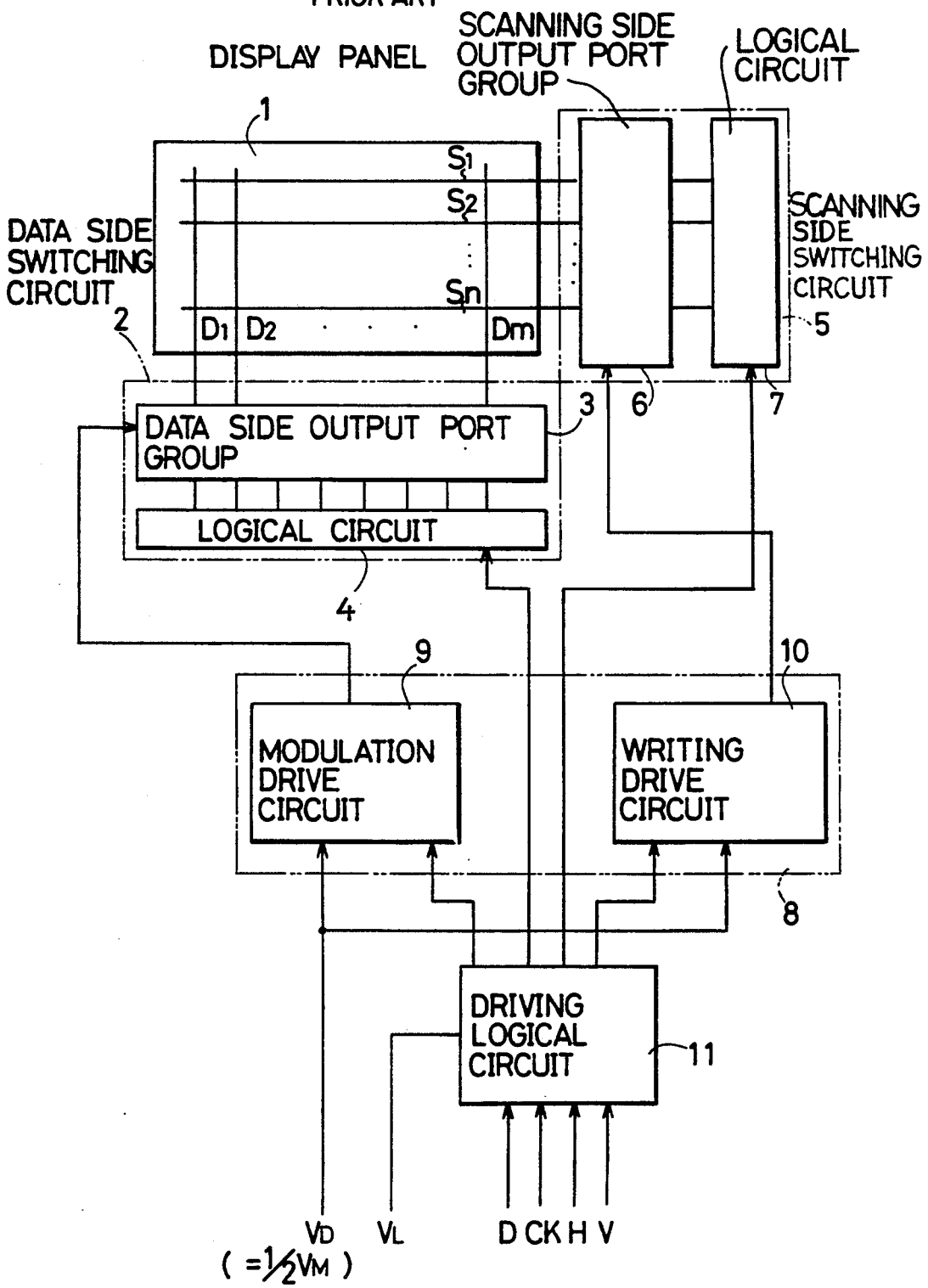
FIG.6 PRIOR ART
FIG. 6 is a block diagram showing a schematic structure of a conventional thin film EL display unit.
Figure 8:
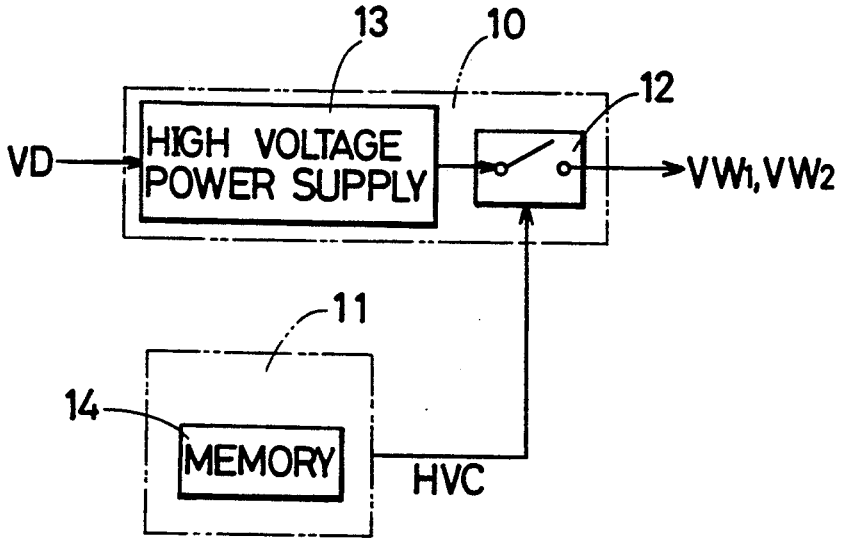
FIG.8 PRIOR ART
FIG. 8 is a block diagram showing a main part of a circuit structure of the conventional thin film EL display unit.

A thin film EL display unit is shown in this embodiment of the present invention and its schematic structure is the same as the common thin film EL display unit shown in FIGS. 6 and 8, so that its structure is not shown and its description is omitted here.

According to the first embodiment of the present invention, timing data is previously written in a memory 14 so that a control signal HVC may be output. This signal is applied from the memory 14 of the driving logical circuit 11 shown in FIG. 8 to the switching element 12 of the writing drive circuit 10 and its pulse width is narrower than its should be while first few lines of the scanning side electrodes, for example the scanning side electrode S1 to the scanning side electrode S4, are specified, and it is gradually increased as the scanning side electrode is sequentially specified.

Figure 7:
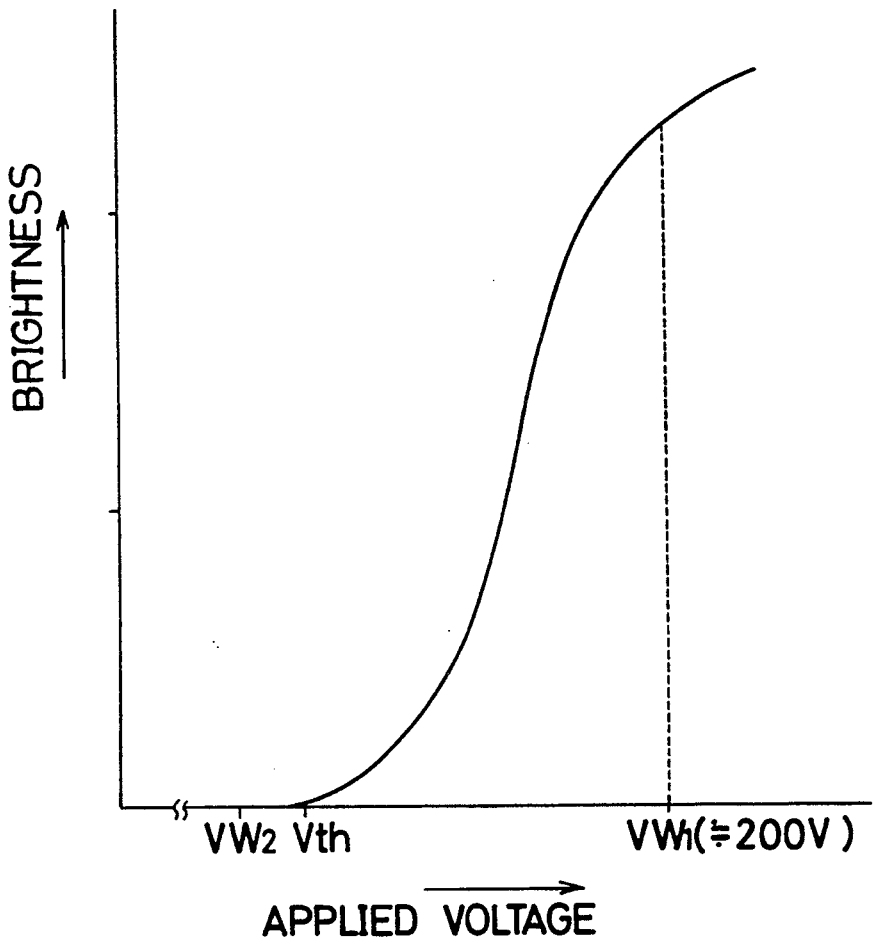
FIG.7 PRIOR ART
FIG. 7 is a view showing an applied voltage-brightness characteristic of the thin film EL element.

Therefore, according to the display unit of the present embodiment, after the high voltage HV of the high voltage power supply 13, whose level is increased for a blank period, starts to apply a writing voltage to the scanning side electrode, it is gradually decreased to a predetermined level, while the amplitude of the writing voltage is accordingly increased. The more the amplitude thereof is, the narrower the pulse width thereof becomes as shown in FIG. 1(2). The more the amplitude of the writing voltage is, the more the effective voltage applied to the pixel of the display panel 1 is. Thus, brightness of the pixel is also increased as can be seen from the applied voltage-brightness characteristic shown in FIG. 7. Meanwhile, the shorter the period of voltage application is, more specifically, the narrower the pulse width of the writing voltage becomes, the shorter an emission time of the pixel becomes. As a result, the brightness of the pixel on each of the scanning side electrodes S1 to Sn is about the same.

Figure 2:
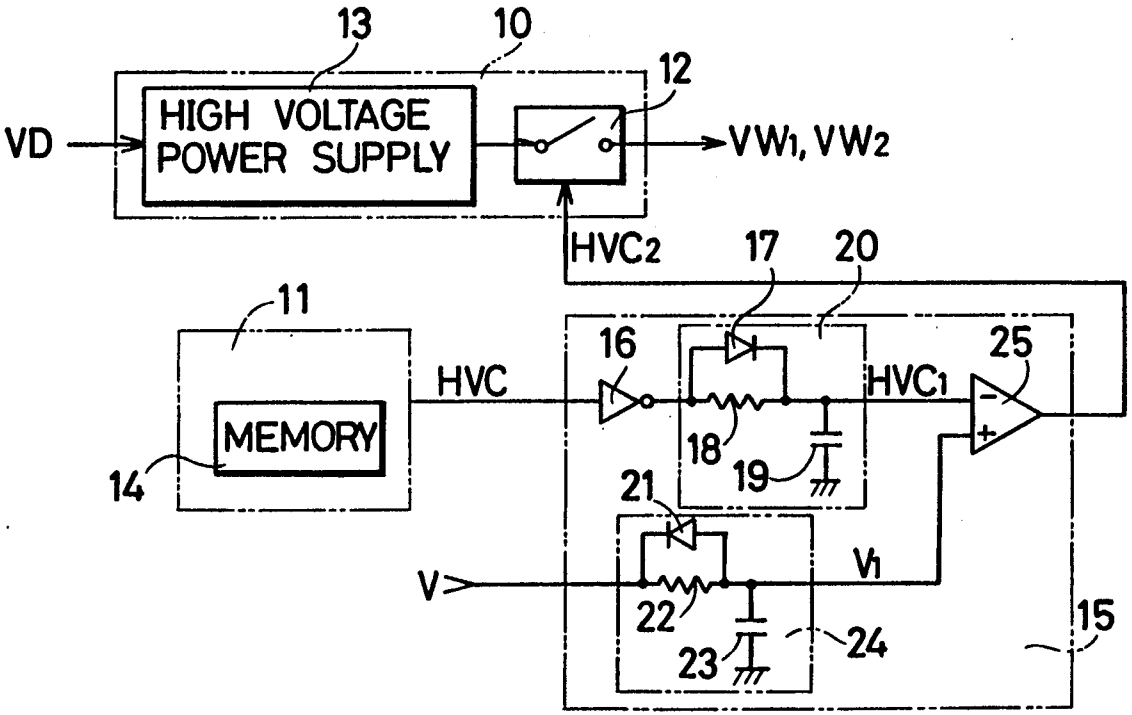
FIG. 2 is a view showing a main part of a circuit structure of a display unit in accordance with a second embodiment of the present invention.

FIG. 2 is a view showing connection of the writing drive circuit 10 and the driving logical circuit 11 of the thin film EL display unit in accordance with a second embodiment of the present invention.

The structure of the writing drive circuit 10 and the driving logical circuit 11 is the same as the conventional structure shown in FIG. 8 except that the control signal HVC output from the driving logical circuit 11 is converted to another control signal HVC 2 by a converting circuit 15 and applied to the switching element 12 of the writing drive circuit 10.

More specifically, the converting circuit 15 comprises an inverter 16 which inverts the control signal HVC output from the driving circuit 11, an integrating circuit 20 comprising a diode 17, a resistor 18 and a capacitor 19 for integrating the signal inverted by the inverter 16, an integrating circuit 24 comprising a diode 21, a resistor 22 and the capacitor 23 for integrating the vertical synchronizing signal V, and a comparator 25 which compares an output HVC 1 of the integrating circuit 20 with an output V1 of the integrating circuit 24.

Figure 3:
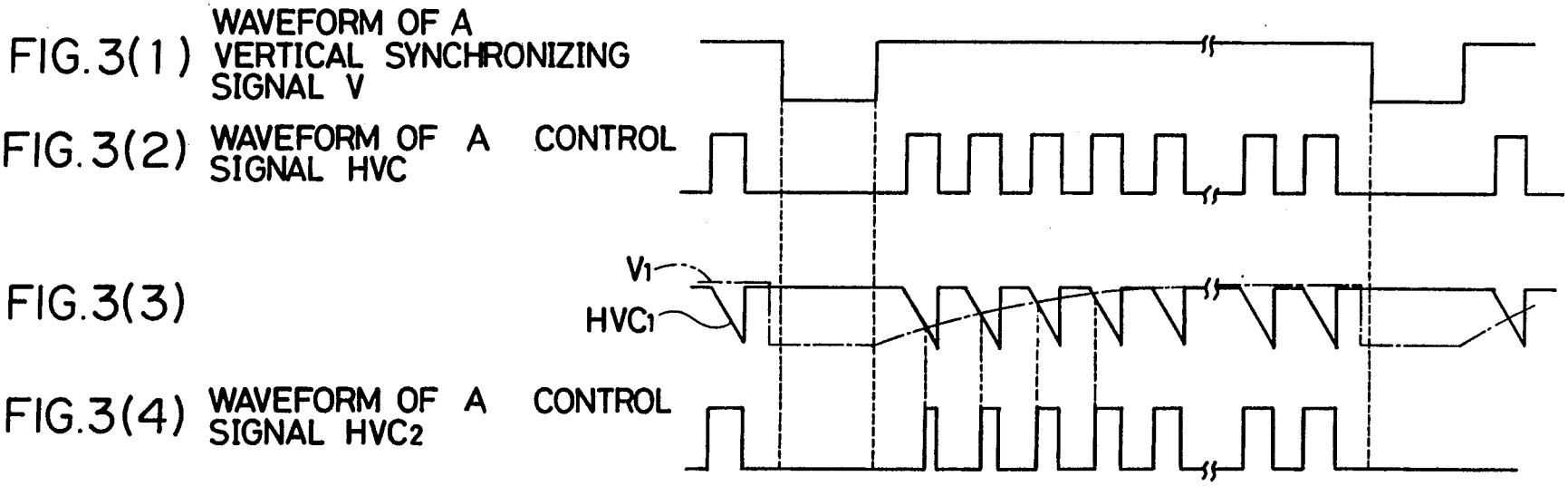
FIGS. 3(1–4) are timing charts showing drive timing of the display unit.

FIG. 3 is a timing chart showing operation of the converting circuit 15, in which FIG. 3(1) shows a waveform of the vertical synchronizing signal V; FIG. 3(2) shows a waveform of the control signal HVC output from the driving logical circuit 11; FIG. 3(3) shows waveforms of the signals HVC1 and V1 output from the integrating circuits 20 and 24, respectively; and FIG. 3(4) shows a waveform of the control signal HVC2 output from the converting circuit 15.

Next, the operation of the converting circuit 15 will be described in reference to the timing charts shown in FIG. 3.

The control signal HVC shown in FIG. 3(2) is inverted by the inverter 16 and then converted to the signal HVC1 having an integration waveform shown by a solid line in FIG. 3(3) by the integrating circuit 20.

Meanwhile, the vertical synchronizing signal V shown in FIG. 3(1) is converted to the signal V1 having an integration waveform shown by an alternate long and short dash line in FIG. 3(3).

The signal HVC1 is input to an inversion input terminal of the comparator 25 and the signal V1 is input to a non-inversion input terminal of the comparator 25, so that the comparator 25 outputs the control signal HVC2 which becomes high level only while the signal V1 is at a high level as compared with the signal HVC1 as shown in FIG. 3(4), which signal is applied to the switching element 12 of the writing drive circuit 10. The control signal HVC2 is a signal corresponding to the control signal HVC shown in FIG. 3(2) and its pulse width is sufficiently narrow at the beginning of the field and then gradually increased to be like the pulse width of the original control signal HVC. As a result, the writing voltage from the writing drive circuit 10, whose pulse width is controlled by the control signal HVC2, has the same waveform as the pulse waveform shown in FIG. 1(2). Therefore, in this embodiment of the present invention also, brightness of the pixel is uniform in a vertical direction on the screen of the display panel 1 without being influenced by the fluctuation of the high voltage output of the high voltage power supply 13.

Figure 4:
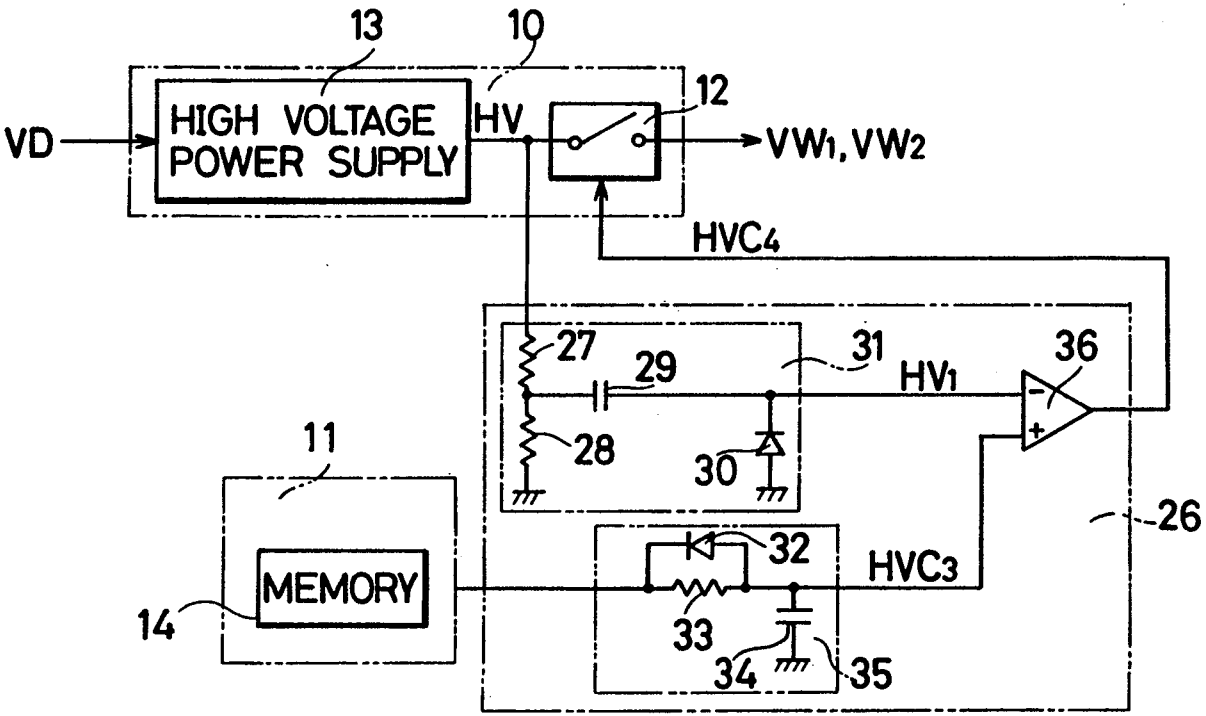
FIG. 4 is a view showing a main part of a circuit structure of a display unit in accordance with a third embodiment of the present invention.

FIG. 4 is a view showing a connection structure of the writing drive circuit 10 and the driving logical circuit 11 in a thin film EL display unit in accordance with a third embodiment of the present invention.

According to this embodiment of the present invention, the control signal HVC output from the driving logical circuit 11 is converted to another control signal HVC4 by the converting circuit 26 to be applied to the switching element 12 in the writing drive circuit 10 and other structure is the same as that of the second embodiment of the present invention.

More specifically, the converting circuit 26 comprises a filter 31 comprising resistors 27 and 28, a capacitor 29 and a diode 30 and takes out an AC element HV1 from the high voltage HV output from the high voltage power supply 13; an integrating circuit 35 comprising a diode 32, a resistor 33 and a capacitor 34 and integrating the control signal HVC output from the driving logical circuit 11, and a comparator 36 which compares the output signal HV1 from the filter 31 with the output signal HVC3 from the integrating circuit 35.

Figure 5:
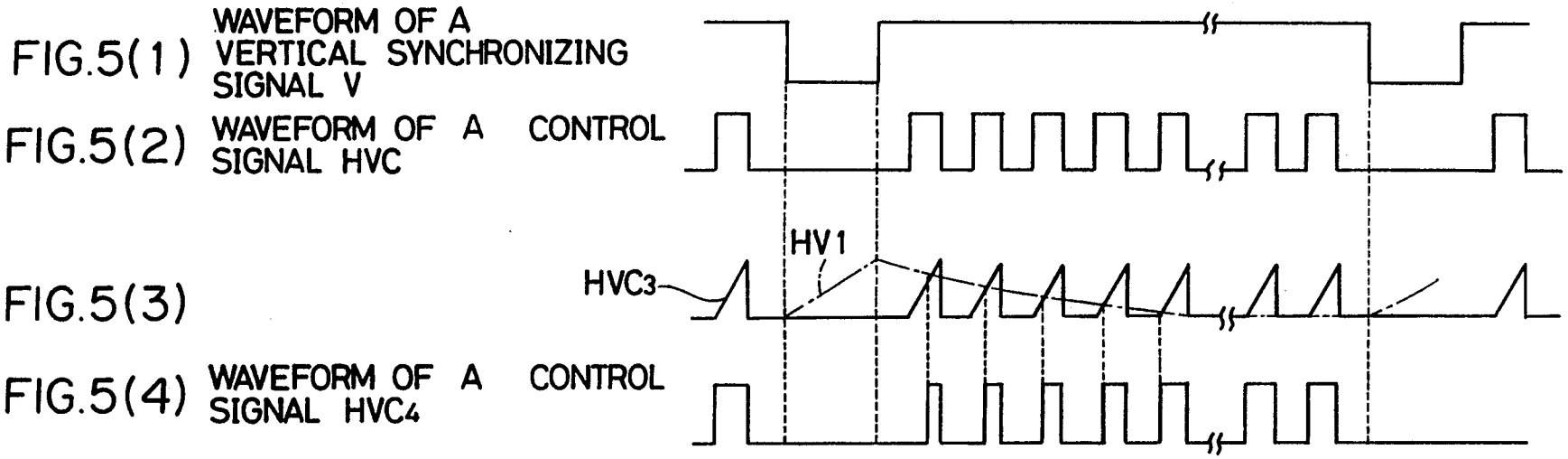
FIGS. 5(1–4) are timing charts showing drive timing of the display unit the display unit.

FIG. 5 is a timing chart showing operation of the converting circuit 26, in which FIG. 5(1) shows a waveform of the vertical synchronizing signal V; FIG. 5(2) shows a waveform of the control signal HVC output from the driving logical circuit 11; FIG. 5(3) shows waveforms of the signals HV1 and HVC3 output from the filter 31 and the integrating circuit 35, respectively and FIG. 5(4) shows a waveform of the control signal HVC4 output from the converting circuit 26.

Next, the operation of the converting circuit 26 will be described in reference to the timing chart shown in FIG. 5.

The control signal HVC shown in FIG. 5(2) is converted to the signal HVC3 having the integration waveform shown by a solid line in FIG. 5(3) by the integrating circuit 35.

Meanwhile, the AC element HV1 having the waveform shown by an alternate long and short dash line in FIG. 5(3) is taken out from the high voltage HV shown in FIG. 5(1) by the filter 31.

The AC element HV1 is input to the inversion input terminal of the comparator 36 and the signal HVC3 is input to the non-inversion input terminal of the comparator 36, so that the comparator 36 outputs the control signal HVC4 which becomes a high level only while the signal HVC3 is at a high level as compared with the AC element HV1 as shown in FIG. 5(4). Then, the signal is input to the switching element 12 of the writing drive circuit 10. The control signal HVC4 is a signal corresponding to the control signal HVC and its pulse width is sufficiently narrow at the beginning of the field and then gradually increases to be like the pulse width of the original control signal HVC. As a result, the writing voltage from the writing drive circuit 10, whose pulse width is controlled by the control signal HVC4, has the same waveform as the pulse waveform shown in FIG. 1(2). Therefore, in this embodiment of the present invention also, the brightness of the pixel is uniform in a vertical direction on a screen of the display panel 1 without being influenced by the fluctuation of the high voltage output of the high voltage power supply.

In addition, although the present invention is applied to the thin film EL display unit in the above mentioned embodiments, the present invention is not limited to this and also can be applied to another flat matrix display driven by a pulse.

While only certain presently preferred embodiments have been described in detail, as will be apparent with those skilled in the art, certain changes and modifications can be made without departing from the scope of the invention as defined by the following claims.

What is claimed is:

1. A display unit having a brightness control function comprising:

a display panel including a plurality of scanning side electrodes arranged in parallel in a first direction and a plurality of data side electrodes arranged in parallel in a second direction with a pixel located at every intersecting scanning side electrode and the data side electrode;

scanning side switching circuit, connected to the scanning side electrodes, for selectively outputting a high voltage to the scanning side electrodes to sequentially specify a pixel row;

a data side switching circuit, connected to the data side electrodes, for outputting a signal voltage to the data side electrodes to apply the signal voltage corresponding to display data to each pixel column;

a scanning side drive circuit, including a high voltage power supply and a switching element, for generating a high voltage and supplying a high voltage pulse to the scanning side switching circuit in response to the scanning side switching circuit sequentially specifying a row of the pixel;

a data side drive circuit for inputting the signal voltage to the data side switching circuit; and control means for outputting a control signal for controlling the high voltage pulse by decreasing pulse width in proportion to increasing voltage level so as to maintain a uniform area for each high voltage pulse.

2. The display unit of claim 1, wherein the control means includes a memory for storing timing data for outputting a control signal to the switching element so as to decrease pulse width in proportion to increasing voltage level to maintain a uniform pulse area.

3. The display unit of claim 1, wherein the control means comprises:

a memory for storing a predetermined control signal of uniform pulse width and voltage level; and a converting circuit including, first integrating means for integrating the control signal output from the memory;

second integrating means for integrating a vertical synchronizing signal; and a comparator for comparing an output of the first integrating means with an output of the second integrating means, and converting the control signal output from the memory to a control signal, for controlling intermission of the switching element connected to the high voltage power supply to decrease the pulse width of each high voltage pulse in proportion to increasing voltage level.

4. The display unit of claim 1, wherein the control means comprises:

a memory for storing timing data of a predetermined control signal of uniform pulse width and voltage level; and a converting circuit including, filtering means for taking out an AC element from a high voltage output from the high voltage power supply;

integrating means for integrating the control signal output from the memory; and comparator for comparing an output signal from the filtering means with an output from the integrating means, and for converting the timing data output from the memory to a control signal, for controlling intermission of the switching element connected to the high voltage power supply, to decrease the pulse width of each high voltage pulse in proportion to increasing voltage level.

5. A method for driving a display device to maintain uniform brightness, the display device including a display panel with intersecting data and scan electrodes, a data electrode driving circuit, connected to the data electrodes, and a scan electrode driving circuit, including a high voltage power supply, connected to the scan electrodes, the method comprising the steps of:

a) driving the data electrodes with the data electrode driving circuit, based upon an input data signal;

b) driving the scan electrodes with the scan electrode driving circuit, sequentially, based upon a pulsed voltage output from the high voltage power supply; and c) controlling the pulsed voltage output from the high voltage power supply by decreasing pulse width in proportion to increasing voltage level so as to maintain a uniform pulse area.

6. The method of claim 6, wherein the scan electrode driving circuit includes a memory and step (c) includes controlling the pulsed voltage output by decreasing pulse width in proportion to increasing voltage level based upon prestored information in the memory.

7. The method of claim 5, wherein the scan electrode driving circuit further includes a converter and a memory and step (c) includes the substeps:

(i) comparing, in the converter, a predetermined control signal of uniform pulse width and voltage level, prestored and output from the memory, to the voltage of increasing voltage level, output from the high voltage power supply; and (ii) converting, in the converter, the predetermined control signal of uniform pulse width to a control signal of decreasing pulse width in proportion to the increasing voltage level of the output from the high voltage power supply, so as to maintain a uniform pulse area.

8. The method of claim 5, wherein the scan electrode driving circuit further includes a converter and a memory and step (c) includes the substeps:

(i) comparing, in the converter, a predetermined control signal of uniform pulse width and voltage level, prestored and output from the memory, to a vertical synchronizing signal of the display device; and (ii) converting, in the converter, the predetermined control signal of uniform pulse width and voltage level to a control signal of decreasing pulse width in proportion to the increasing voltage level of the output from the high voltage power supply and of gradually increasing pulse width subsequent to a blanking period of the vertical synchronizing signal.

9. The method of claim 7, wherein the substep (i) includes the further substeps of:

(a) filtering out an AC element from the voltage output from the high voltage power supply for subsequent comparing; and (b) integrating the predetermined control signal of uniform pulse width and voltage level for subsequent comparing.

10. The method of claim 8, wherein the substep (i) includes the further substeps of:

(a) integrating the predetermined control signal of uniform pulse width and voltage level for subsequent comparing; and (b) integrating the vertical synchronizing signal for subsequent comparing.

11. A system for driving a display device to maintain uniform brightness, the display device including a display panel with intersecting data and scan electrodes, the system comprising:

data electrode driver for driving the data electrodes based upon an input signal;

scan electrode driver, including a high voltage power supply, for driving the scan electrodes, sequentially, based upon a pulsed voltage output from the high voltage power supply circuit, the scan electrode driver further including a controller, connected to the high voltage power supply, for controlling the pulsed voltage output from the high voltage power supply by decreasing pulse width in proportion to increasing voltage level so as to maintain a uniform pulse area.

12. The system of claim 11, wherein the scan electrode driver further includes a memory for supplying prestored information to the controller for controlling pulse voltage output from the high voltage power supply.

13. The system of claim 11, wherein the controller includes:

memory for storing a predetermined control signal of uniform pulse width and voltage level; and converter for comparing the predetermined control signal from the memory to the voltage, of increasing voltage level, output from the high voltage power supply, and for converting the predetermined control signal of uniform pulse width and voltage level to a control signal of decreasing pulse width in proportion to the increasing voltage level of the output from the high voltage power supply, so as to maintain a uniform pulse area.

14. The system of claim 11, wherein the controller includes:

memory for storing a predetermined control signal of uniform pulse width and voltage level; and converter for comparing the predetermined control signal of uniform pulse width and voltage level from the memory to a vertical synchronizing signal of the display device and for converting the predetermined control signal of uniform pulse width and voltage level to a control signal of decreasing pulse width in proportion to the increasing voltage level of the output from the high voltage power supply and for gradually increasing pulse width subsequent to a blanking period of the vertical synchronizing signal.

15. The system of claim 13, wherein the converter further includes:

filter for filtering out an AC element from the pulsed voltage output from the high voltage power supply for subsequent comparing; and integrator for integrating the predetermined control signal of uniform pulse width and voltage level for subsequent comparing.

16. The system of claim 14, wherein the converter further includes:

a first integrator for integrating the predetermined control signal of uniform pulse width and voltage level for subsequent comparing; and a second integrator for integrating the vertical synchronizing signal for subsequent comparing.

* * * * *